United States Patent [19]

Arriazu

[11] Patent Number: 4,736,184

[45] Date of Patent: Apr. 5, 1988

[54] DIRECT CONNECTION POTENTIOMETER

[75] Inventor: Carlos L. Arriazu, Tudela, Spain

[73] Assignee: Piher Navarra, S.A., Tudela, Spain

[21] Appl. No.: 799,860

[22] Filed: Nov. 20, 1985

[51] Int. Cl.[4] ..... H01C 10/32

[52] U.S. Cl. ..... 338/162; 338/170; 338/172; 338/171

[58] Field of Search ..... 338/162, 170, 171, 172, 338/132, 202

[56] References Cited

U.S. PATENT DOCUMENTS 3,924,207 12/1975 Simoni ..... 338/132 X 4,105,987 8/1978 Spence et al. ..... 333/202 X

*Primary Examiner*—Clifford C. Shaw

*Assistant Examiner*—M. M. Lateef

*Attorney, Agent, or Firm*—Cushman, Darby & Cushman

[57] ABSTRACT

The direct connection potentiometer includes a block of electrically insulative material having two opposite faces and an edge about the perimeter of the faces. An electroresistive track is provided in an arc on the front face of the block, radially spaced from a ring-shaped conductive area provided on that face. Conductive strips extend from each end of the track, and from the ring-shaped conductive area to the perimeter of the front face, where each, spaced from the others, wraps around the edge of the block to its rear face. A rotatable cursor, i.e. a slide is mounted to the block centrally of the ring-shaped conductive area and connects the ring-shaped conductive area with a selected arcuately short portion of the electroresistive track.

10 Claims, 3 Drawing Sheets

DIRECT CONNECTION POTENTIOMETER

BACKGROUND OF THE INVENTION

The present invention relates to potentiometers and more particularly to an improved direct connection potentiometer.

SUMMARY OF THE INVENTION

The primary feature of the new potentiometer is its structural simplicity which allows the employment of automated manufacture and in consequence the automatic assembly of circuits and equipment in series production. This simplicity of construction results furthermore in a notable reduction in the cost of the component.

Another feature of the new potentiometer is the possibility of direct mounting within the circuit of which it is to form a part by the soldering of the circuit terminations to the potentiometer terminals which are in the form of electroconductive deposits, the absence of the classic type of terminal connectors resulting in a reduction in the dimensions of the component.

To assist in the explanation, drawings are attached to this specification, showing by way of a non-limitative illustration, one embodiment of a direct mounting potentiometer in accordance with the principles enunciated in the claims.

DETAILED DESCRIPTION

The numbers on the drawings correspond to the references indicated below.

The variable resistance device as described consists of a track support body —1—, in the form of a modified quadrangular block of an insulating material such as alumina, the electro-resistive track —2—, on one of its faces (namely, its front face) being a serigraphic deposit (i.e. a silkscreened coating of which the extremities join into areas of silver deposition —3— and —4—, similarly carried out, for purposes of providing the soldered connection of the potentiometer. The areas —5— and —6— provide the juxtaposition of the conductive zones, ensuring their permanent contact despite vibration or other mechanical action.

The body —1—, having preferably two of its vertices bevelled, —7—, is provided on the perimetrical edge opposite these bevels, with recesses —8— and —9—, thus forming three rectangular projections of equal size, corresponding to the areas —3— and —4—, with a central conductive area in the form of a circular ring —10—, a extension —11— of which is provided on the third projection, which is disposed on a site spaced from between the areas —3— and —4— by the recesses 8 and 9.

Figure 4:
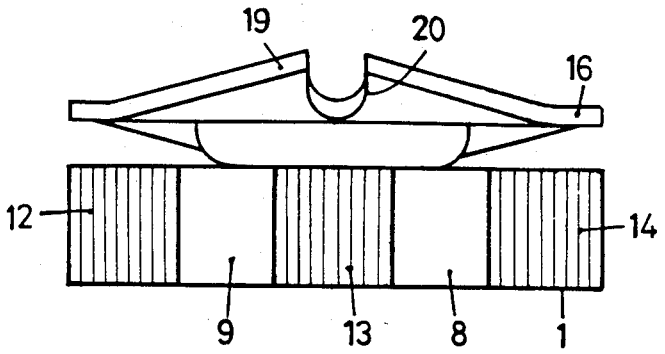
FIG. 4 is a bottom plan view of the device looking towards the side carrying the connection surfaces.
Figure 1:
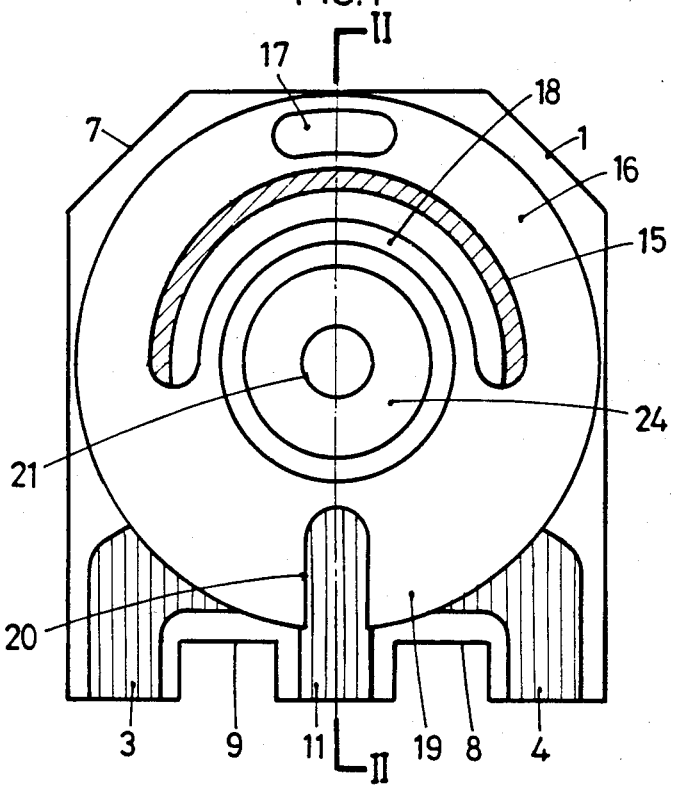
FIG. 1 is a front elevation view of the new variable resistance device.
Figure 2:
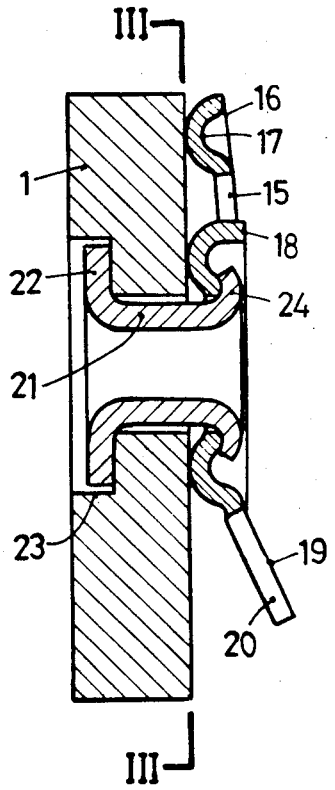
FIG. 2 is a longitudinal cross sectional view taken along the center plane line II—II of FIG. 1.
Figure 3:
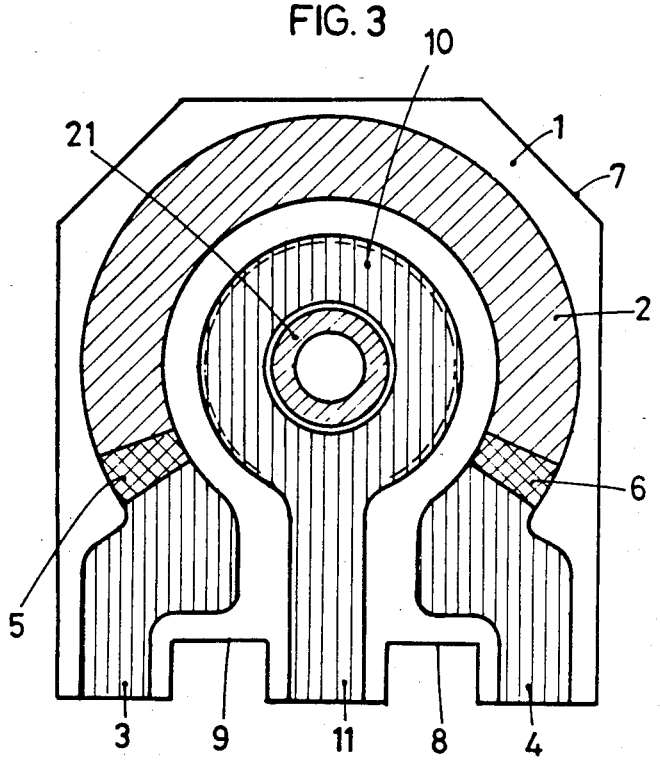
FIG. 3 is a transverse sectional view of the device, taken through the rotating member, on the plane III—III of FIG. 2.

An important feature of the device is that the electroconductive bands extend across the perimetrical edge surface of the block 1 on the projections defined between the recesses —8— and —9—, such that they define electro conductive areas —12—, —13— and —14— (see FIG. 4), which continue on the rear face of the block (see FIG. 2). In use, this potentiometer is connected to an electrical circuit (not shown) by the direct soldering of the conductive areas 12, 13 and 14, employing for this purpose machines of various types designed for the insertion and assembly of this type of component.

An alternative version of the device (not shown) has the conductor —10— in connection with the metallized area —3—, eliminating the strip —11—, the potentiometer becoming a variable resistor with two connection terminations.

The cursor (i.e. the slide of the potentiometer) consists of a metal element, in alpaca or in a similar alloy, discoidal as shown in figure —1— and having a circumferential arc-shaped opening —15— and an area in the shape of a semi-corona (i.e. a semi-circular ring) —16—, the latter having within it a curvilinear section indentation (i.e. a protrusion towards the front face of the block) —17—, designed to remain in contact with the resistive track —2—. The central part of the cursor is in the form of a semi-circular section circular zone —18— which is in continuous sliding contact with the central corona —10— thus providing the contact between the latter with its extention —11— and the point on the resistive track touched by the indentation —17—.

The operation of the cursor is carried out by direct action on the part —19— which extends away from the front face of the block —1— and is provided with a cutaway (i.e. notch) in the form of a U, —20—.

The cursor is retained in position by means of an axially positioned sleeve —21—, passing through a central hole in the block —1—, one of its extremities being flared over to form an annular flange —22— which lodges in a recess —23— provided in the rear face of the block —1—, the other extremity of the sleeve also being flared to form a corona —24—, retaining the cursor through its center.

I claim:

1. A direct connection potentiometer, comprising:

a track support block of electrically insulative material, said block having a front face and a rear face joined by a perimetrical edge surface;

a track of electroresistive material provided on said front face of said block in an arc about a center so as to have two opposite ends;

a first band of electroconductive material provided on said block, in electrical contact with one end of said track on said front face and extending on said block from said front face onto said edge surface and onto said rear face;

an area of electrically conductive material provided on said front face of said block in an arc about said center, said area being spaced radially of said center from said track;

a second band of electroconductive material provided on said block, in electrical contact with said area of electrically conductive material and extending on said block from said front face onto said edge surface and onto said rear face, whereby respective portions of said first band and said second band extending on said front face, said edge surface and said rear face of said block are available for use as respective first and second terminals; and a cursor mounted to said block for arcuate movement about said center, said cursor having an electrically conductive portion thereof provided both in continuous sliding contact with said area of electroconductive material and with an arcuately short region of said track of electroresistive material, the location of which region is determined by variably positioning said cursor by movement of said cursor about said center.

2. The direct connection potentiometer of claim 1, wherein:

said area extends throughout a circular arc.

3. The direct connection potentiometer of claim 1, further comprising:

a third band of electroconductive material provided on said block, in electrical contact with the opposite end of said track on said front face and extending on said block from said front face onto said edge surface and onto said rear face, whereby a respective portion of said third band extending on said front face, said edge surface and said rear face of said block is available for use as a third terminal.

4. The direct connection potentiometer of claim 1, wherein:

said block is provided with an opening therethrough at said center;

said cursor comprises an approximately disk-shaped member mounted to an axially-extending sleeve;

said disk-shaped member being disposed with a rear face thereof in confronting adjacent relationship with said front face of said block, with said sleeve extending through said opening, and with flange means provided on said sleeve bearing against said rear face of said block.

5. The direct connection potentiometer of claim 4, wherein:

said electrically conductive portion of said cursor comprises:

an electrically conductive arcuate portion of said disk positioned in sliding contact with said area of electrically conductive material, an electrically conductive protrusion from said disk positioned in sliding contact with an arcuately-short region of said track of electroresistive material, and electrically conductive material of said disk connecting said arcuate portion with said protrusion.

6. The direct connection potentiometer of claim 5, wherein:

said area of electrically conductive material provided on said front face of said block extends throughout a circular arc; and said electrically conductive arcuate portion of said disk comprises a semi-circular ring-shaped region thereof which is radially spaced from said protrusion thereof by an arc-shaped opening provided through said disk.

7. The direct connection potentiometer of claim 4, wherein:

said disk-shaped member includes a marginal portion bent outwardly away from adjacency with said front face of said block, and a U-shaped notch formed in an outer edge of said disk-shaped member within said marginal portion.

8. The direct connection potentiometer of claim 4, wherein:

said block includes a ring-shaped recess in said rear face surrounding said opening, and said flange means is disposed in said recess.

9. The direct connection potentiometer of claim 1, wherein:

said respective portions of said first and second band wrap around said edge surface onto said front and rear faces at respective perimetrically spaced sites and said block is notched edgewise between said sites so as to provide a recess.

10. The direct connection potentiometer of claim 3, wherein:

said respective portions of said first, second and third band wrap around said edge surface onto said front and rear faces at respective perimetrically spaced sites and said block is notched edgewise between respective pairs of said sites so as to provide two respective recesses.

* * * * *